US010022790B2

(12) United States Patent
Lee et al.

(10) Patent No.: US 10,022,790 B2
(45) Date of Patent: Jul. 17, 2018

(54) TURBINE AIRFOIL COOLING SYSTEM WITH LEADING EDGE IMPINGEMENT COOLING SYSTEM TURBINE BLADE INVESTMENT CASTING USING FILM HOLE PROTRUSIONS FOR INTEGRAL WALL THICKNESS CONTROL

(71) Applicant: Siemens Energy, Inc., Orlando, FL (US)

(72) Inventors: Ching-Pang Lee, Cincinnati, OH (US); Nan Jiang, Charlotte, NC (US)

(73) Assignees: SIEMENS AKTIENGESELLSCHAFT, München (DE); MIKRO SYSTEMS, INC., Charlottesville, VA (US)

( * ) Notice: Subject to any disclaimer, the term of this patent is extended or adjusted under 35 U.S.C. 154(b) by 0 days.

(21) Appl. No.: 15/307,073

(22) PCT Filed: Jun. 18, 2014

(86) PCT No.: PCT/US2014/042900
§ 371 (c)(1),
(2) Date: Oct. 27, 2016

(87) PCT Pub. No.: WO2015/195110
PCT Pub. Date: Dec. 23, 2015

(65) Prior Publication Data
US 2017/0087630 A1 Mar. 30, 2017

(51) Int. Cl.
*B22C 9/04* (2006.01)
*B22C 9/10* (2006.01)
(Continued)

(52) U.S. Cl.
CPC ..... *B22D 25/02* (2013.01); *B22C 7/02* (2013.01); *B22C 9/04* (2013.01); *B22C 9/043* (2013.01);
(Continued)

(58) Field of Classification Search
CPC .. B22C 7/02; B22C 9/04; B22C 9/043; B22C 9/10; B22C 9/108; B22C 9/24; B22C 21/14
(Continued)

(56) References Cited

U.S. PATENT DOCUMENTS 3,596,703 A 8/1971 Bishop et al.
3,659,645 A 5/1972 Rose
(Continued)

FOREIGN PATENT DOCUMENTS

EP 1493513 A1 1/2005
EP 1529580 A1 5/2005
(Continued)

OTHER PUBLICATIONS

PCT International Search Report and Written Opinion dated Mar. 11, 2015 corresponding to PCT Application PCT/US2014/042900 filed Jun. 18, 2014. (09 pages).

*Primary Examiner* — Kevin E Yoon

(57) ABSTRACT

A method of forming an airfoil (12), including: abutting end faces (72) of cantilevered film hole protrusions (64) extending from a ceramic core (50) against an inner surface (80) of a wax die (68) to hold the ceramic core in a fixed positional relationship with the wax die; casting an airfoil including a superalloy around the ceramic core; and machining film cooling holes (34) in the airfoil after the casting step to form an pattern of film cooling holes comprising the film cooling
(Continued)

holes formed by the machining step and the cast film cooling holes (102) formed by the film hole protrusions during the casting step.

8 Claims, 6 Drawing Sheets

(51) Int. Cl.

| | |
|---|---|
| ***B22C 9/24*** | (2006.01) |
| ***B22C 21/14*** | (2006.01) |
| ***B22D 25/02*** | (2006.01) |
| ***B22C 7/02*** | (2006.01) |
| ***B22D 29/00*** | (2006.01) |
| ***F01D 5/18*** | (2006.01) |

(52) U.S. Cl.
CPC ..... *B22C 9/108* (2013.01); *B22C 9/24* (2013.01); *B22C 21/14* (2013.01); *B22D 29/001* (2013.01); *F01D 5/186* (2013.01); *F05D 2220/32* (2013.01); *F05D 2230/211* (2013.01)

(58) Field of Classification Search
USPC ..... 164/30, 34, 35, 370, 397–399; 29/889.721; 416/97 R
See application file for complete search history.

(56) References Cited

U.S. PATENT DOCUMENTS

| | | | | |
|---|---|---|---|---|
| 4,068,702 | A | 1/1978 | Herold | |
| 4,078,598 | A | 5/1978 | Kelso et al. | |
| 4,811,778 | A | 5/1989 | Allen et al. | |
| 5,296,308 | A | 5/1994 | Caccavale et al. | |
| 5,609,779 | A * | 3/1997 | Crow | B23K 26/0622 219/121.71 |
| 6,329,015 | B1 | 12/2001 | Fehrenbach et al. | |
| 6,530,416 | B1 | 3/2003 | Tiemann | |
| 7,237,595 | B2 * | 7/2007 | Beck | B22C 9/00 164/302 |
| 7,448,433 | B2 * | 11/2008 | Ortiz | B22C 7/00 164/35 |
| 2011/0113627 | A1 | 5/2011 | Alquier et al. | |
| 2011/0132562 | A1 | 6/2011 | Merrill et al. | |
| 2013/0333855 | A1 | 12/2013 | Merrill et al. | |
| 2014/0271129 | A1 * | 9/2014 | Mueller | F01D 5/186 415/115 |
| 2016/0151829 | A1 * | 6/2016 | Propheter-Hinckley | F01D 5/147 164/529 |

FOREIGN PATENT DOCUMENTS

| | | | | |
|---|---|---|---|---|
| JP | 2006026742 | A | 2/2006 | |
| JP | 2007061912 | A | 3/2007 | |
| JP | 2008138675 | A | 6/2008 | |
| WO | WO-2014113184 | A1 * | 7/2014 | B22C 7/02 |

* cited by examiner

TURBINE AIRFOIL COOLING SYSTEM WITH LEADING EDGE IMPINGEMENT COOLING SYSTEM TURBINE BLADE INVESTMENT CASTING USING FILM HOLE PROTRUSIONS FOR INTEGRAL WALL THICKNESS CONTROL

FIELD OF THE INVENTION

The invention relates to wall thickness control during investment casting of hollow parts having film cooling passages.

BACKGROUND OF THE INVENTION

Investment casting may be used to produce hollow parts having internal cooling passages. During the investment casting process, wax is injected into a wax cavity to form a wax pattern between a core and a wax die. The wax die is removed, and the core and wax pattern are dipped into the ceramic slurry to form a ceramic shell around the wax pattern. The wax pattern is thermally removed, leaving a mold cavity. Molten metal is cast between the ceramic core and the ceramic shell, which are then removed to reveal the finished part.

Any movement between the ceramic core and the wax die may result in a distorted wax pattern. Since the ceramic shell forms around the wax pattern, and the ceramic shell forms the mold cavity for the final part, this relative movement may result in an unacceptable part. Likewise, any movement between the ceramic core and the ceramic shell when casting the airfoil itself may result in an unacceptable part. Specifically, cooling channels formed into a wall of the finished part require that the wall, which is formed by the mold cavity, meet tight manufacturing tolerances. As gas turbine engine technology progresses, so does the need for more complex cooling schemes. These complex cooling schemes may produce passages that range in size from relatively small to relatively large, and hence manufacturing tolerances are becoming more prominent in the design of components.

The nature of the investment casting process, where two discrete parts must be held in a single positional relationship during handling and multiple casting operations, makes holding the tolerances difficult. In addition, the ceramic core itself is relatively long and thin when compared to the wax die and ceramic shell. As a result, when heated, the ceramic core may distort from its originally intended shape. Likewise, the ceramic core may not expand in all dimensions in exactly the same manner as the wax die and/or the ceramic shell. This relative movement may also change the mold cavity and render the final part unacceptable.

In order to overcome this relative shifting, U.S. Pat. No. 5,296,308 to Caccavale et al. describes a ceramic core having bumpers on the ceramic core that touch, or almost touch, the wax die during the wax pattern pour. This controls a gap between the ceramic core and the wax die, and likewise controls a gap between the ceramic core and the ceramic shell. Controlling the gap minimizes shifting between the ceramic core and the ceramic shell, and this improves control of the wall thickness of the airfoil. The bumpers are positioned at key stress regions to counteract distortions. The final part may have a hole where the bumpers were located, between an internal cooling passage and a surface of the airfoil, which allows cooling fluid to leak from the internal cooling passage.

BRIEF DESCRIPTION OF THE DRAWINGS

The invention is explained in the following description in view of the drawings that show.

DETAILED DESCRIPTION OF THE INVENTION

The present inventors have devised an innovative ceramic core that will enable wall thickness control without the unwanted cooling air leakage associated with the prior art. Specifically, the core disclosed herein forms the typical serpentine cooling passages in the conventional manner, but further includes film hole protrusions that extend from the conventional core. The film hole protrusions are configured to abut an inner surface of a wax die, and then an inner surface of a ceramic shell, in a manner that holds the ceramic core in a fixed positional relationship with the wax die and the ceramic shell. Each film hole protrusion will generate a respective hole in a subsequently cast airfoil. However, unlike the prior art, where the associated holes are minimized, or avoided altogether, to minimize cooling air leakage, the holes associated with the film hole protrusions disclosed here are instead sized and shaped to become film cooling holes, and positioned to be part, if not all, of a pattern of film cooling holes within a film cooling arrangement. By sizing, shaping, and positioning the film hole protrusions in this way there is no unwanted loss of cooling fluid. Instead, the resulting hole and associated cooling fluid flowing there through are innovatively used as part of a film cooling arrangement.

Figure 1:
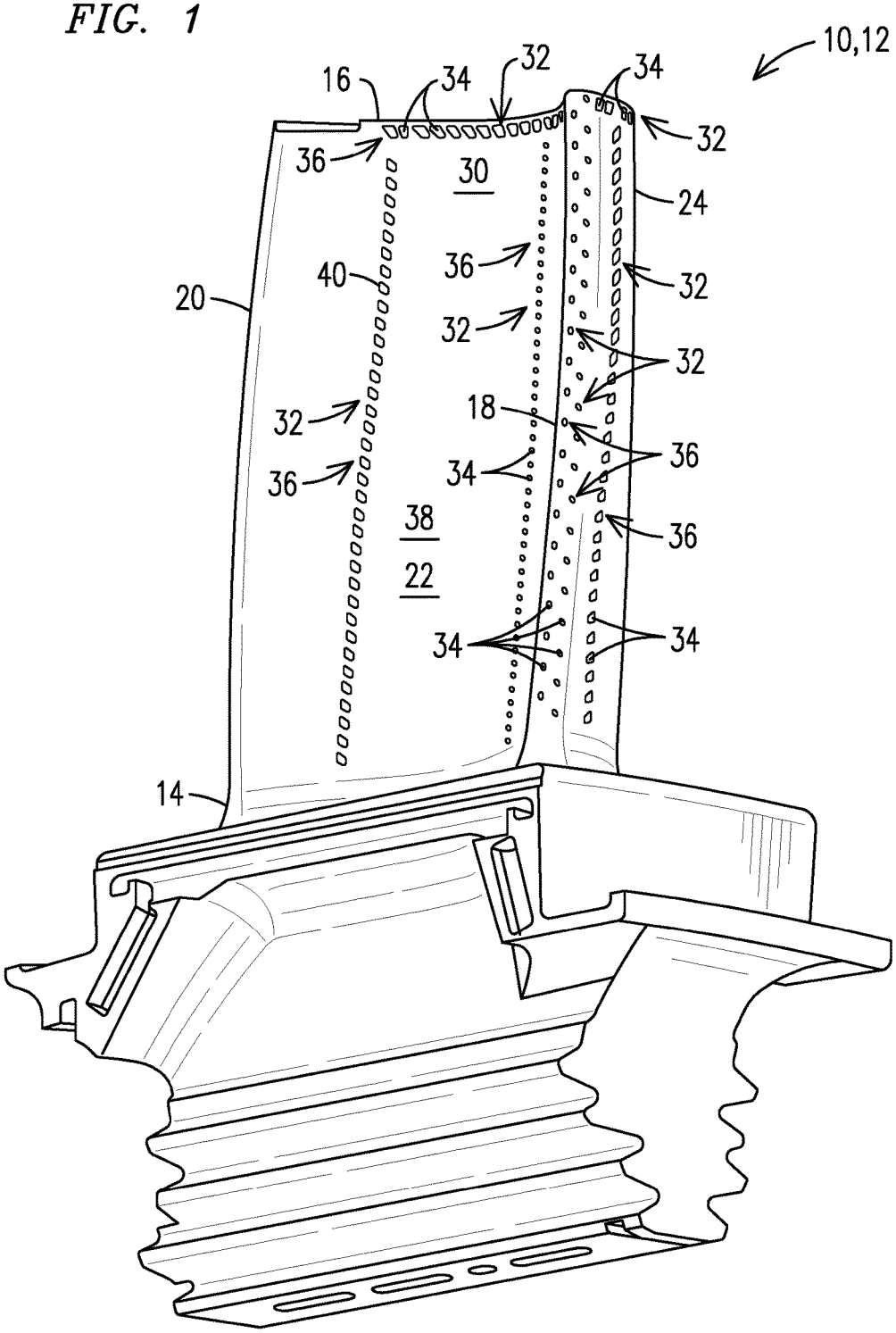
FIG. 1 shows a pressure side of a blade having a film cooling arrangement.
Figure 2:
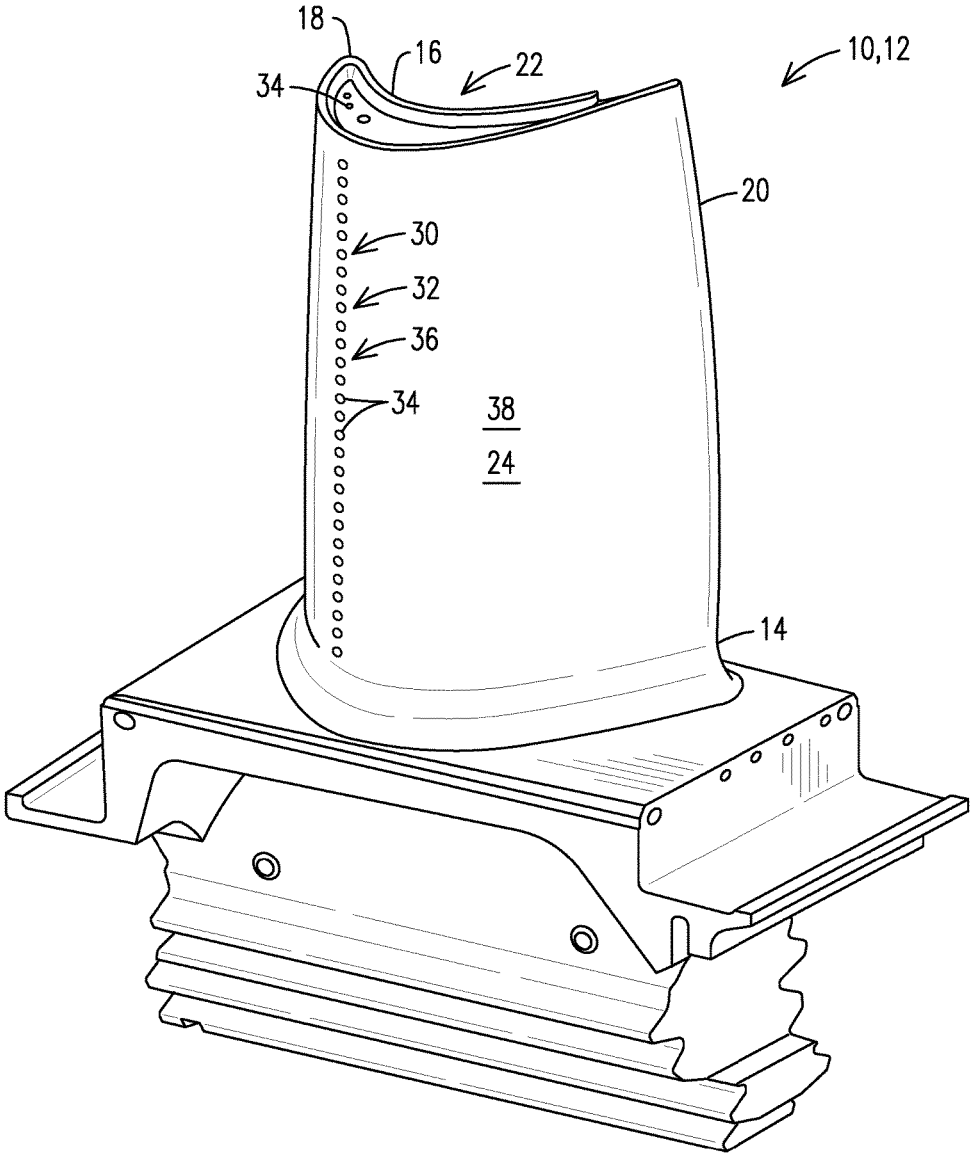
FIG. 2 shows a suction side of the blade of FIG. 1.

FIG. 1 shows a blade 10 for a gas turbine engine (not shown) having an airfoil 12 with a base 14, a tip 16, a leading edge 18, a trailing edge 20, a pressure side 22, and a suction side 24. A film cooling arrangement 30 may have multiple groups 32 of film cooling holes 34. Each group 32 may form its own pattern, such as a row 36 as is visible in this exemplary embodiment. Other patterns are envisioned, however, and are considered within the scope of this disclosure. Each of these film cooling holes 34 is configured to eject an individual stream of cooling fluid, such as air. The individual streams unite with each other and flow along a surface 38 of the airfoil, between hot gases and the airfoil surface 38, thereby protecting the airfoil surface 38 from the hot gases. An outlet 40 of the film cooling hole 34 may be shaped to enhance the surface coverage. The shape may include that of a diffuser, which slows down the air escaping from the film cooling hole 34. In one exemplary embodiment the shape may take the 10-10-10 configuration known to those in the art. FIG. 2 shows the suction side 24 of the airfoil 12.

Figure 3:
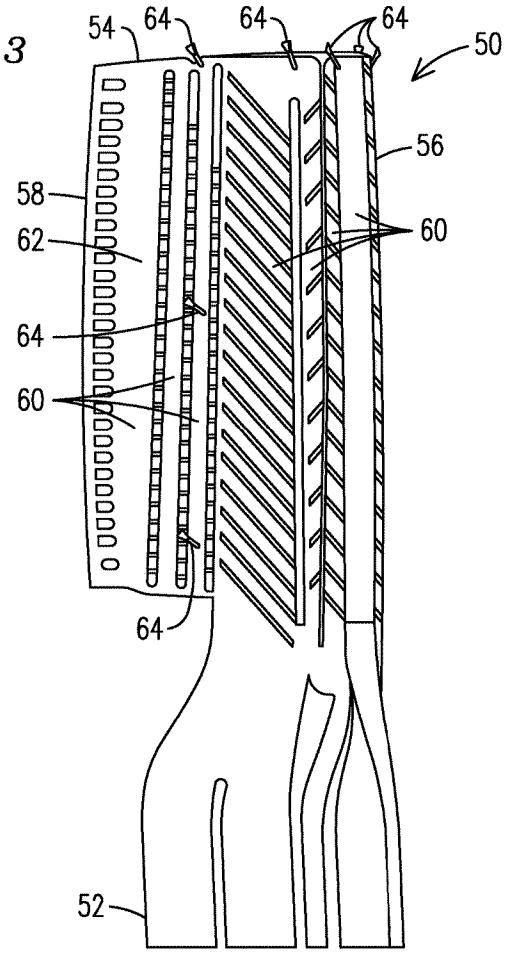
FIG. 3 shows a pressure side of a core used to form the blade of FIG. 1.

FIG. 3 shows an exemplary embodiment of a core 50, which may be made of ceramic. The core 50 includes a core base 52, a core tip 54, a core leading edge 56, a core trailing edge 58, and core passageway structures 60, from a pressure side 62 of the core 50. In the blade 10 the core passageway structures 60 form internal passageways (not shown) that carry cooling fluid through the component. Extending from the core passageway structures 60 are a plurality of film hole protrusions 64. It can be seen that the plurality of film hole protrusions 64 are positioned to coincide with the film cooling holes 34 of FIGS. 1 and 2. Specifically, the film hole protrusions 64 located at the core tip 54 are positioned so that they form film cooling holes 34 that become part of the pattern/row 36 disposed parallel to the tip 16 of the airfoil 12 of FIG. 1. There are fewer film hole protrusions 64 located at the core tip 54 than there are film cooling holes 34 located at the tip 16 in this exemplary embodiment. In this exemplary embodiment, the remaining needed film cooling holes 34 at the tip 16 not formed by the film hole protrusions 64 would need to be formed through a secondary machining operation. In an alternate exemplary embodiment, there could be as many film hole protrusions 64 as needed to form all of the film cooling holes 34 in the row 36 at the tip 16. Likewise, there could be fewer film hole protrusions 64 than there are film cooling holes 34 on the entire airfoil 12, which would necessitate subsequent machining to create the remaining needed film cooling holes 34, or there could be as many film hole protrusions 64 as there are film cooling holes 34 on the entire airfoil 12. In the exemplary embodiment of FIG. 3, locations for the film hole protrusions 64 are selected to coincide with both a desired location of a film cooling hole and a location that will help maintain a shape of the core 50 within the wax die.

Figure 4:
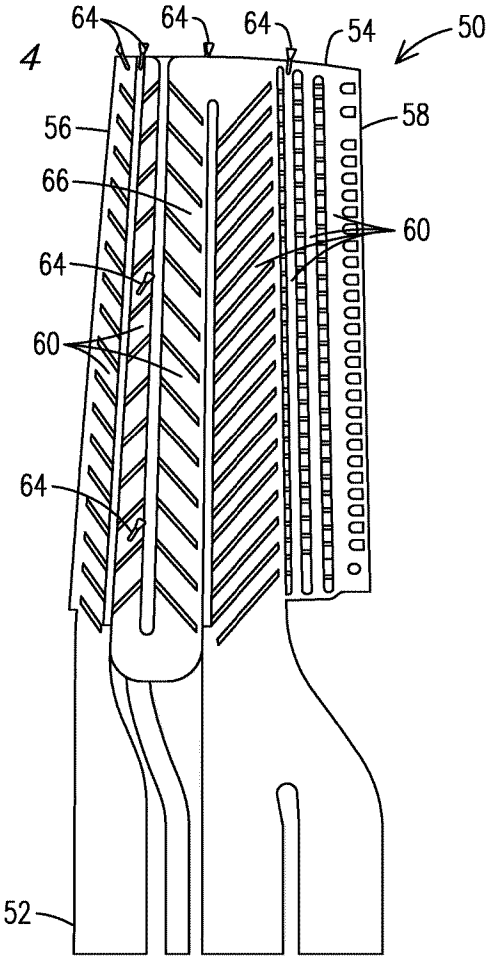
FIG. 4 shows a suction side of a core used to form the blade of FIG. 1.

FIG. 4 shows a suction side 66 the core 50 of FIG. 3, and more film hole protrusions 64 extending from the core passageway structures 60. The film hole protrusions 64 can extend from any or all of the pressure side 62, the suction side 66, the core base 52, and the core tip 54; wherever a film cooling hole is needed. Likewise, the film hole protrusion 64 need not form a film cooling hole, but can instead form, for example, a shank impingement cooling hole. The film hole protrusions 64 can be located anywhere there exists an arrangement for cooling a surface of the blade 10.

Figure 5:
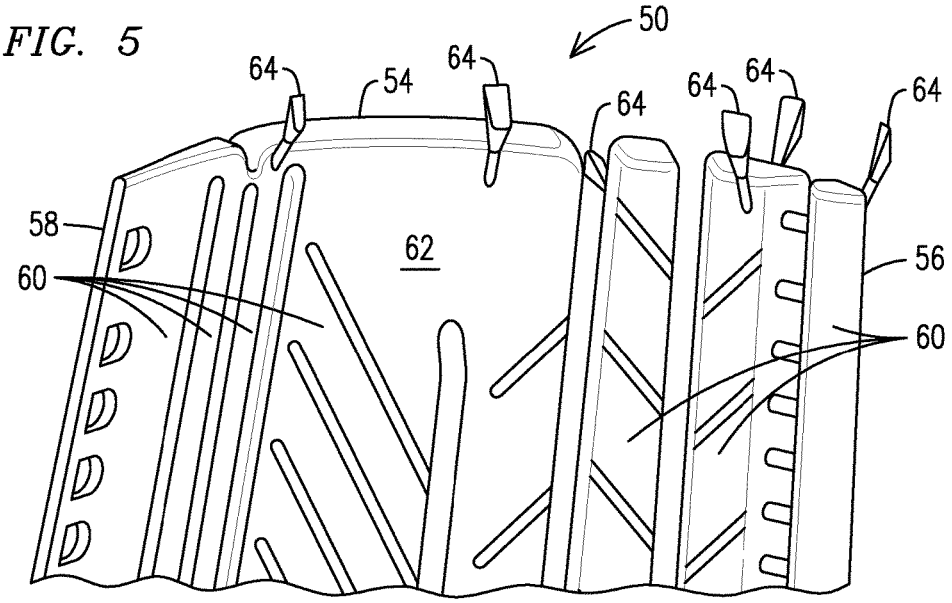
FIG. 5 shows a close-up of a tip of the core of FIG. 3.
Figure 6:
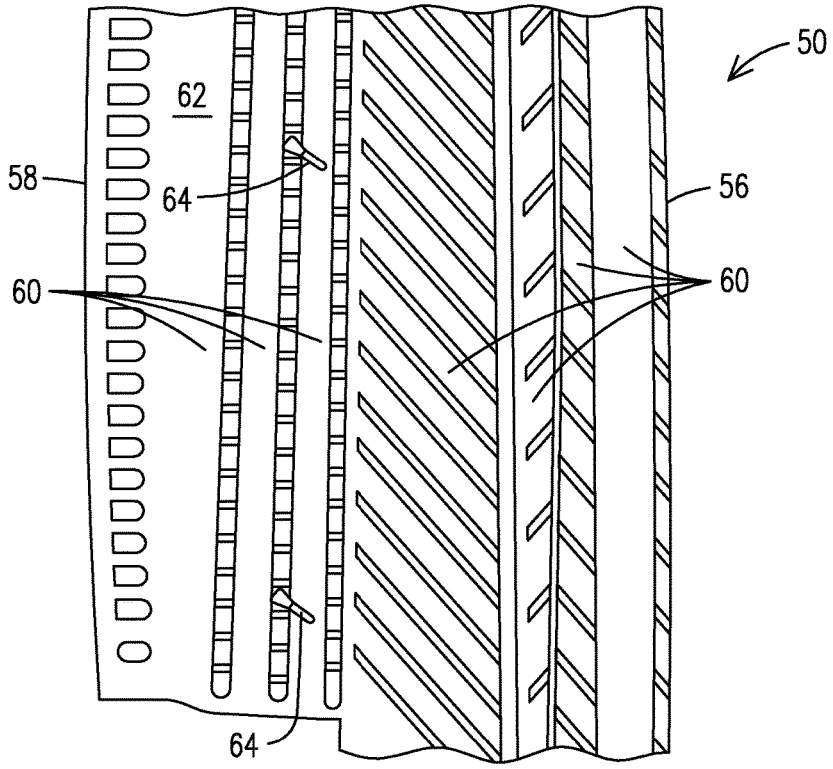
FIG. 6 shows a close-up of the core of FIG. 3.
Figure 7:
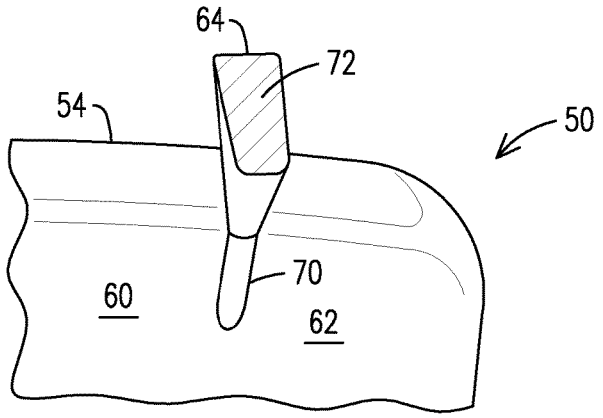
FIG. 7 shows a close-up of a film hole protrusion of FIG. 5.

FIG. 5 shows a close-up of a film hole protrusion 64 extending from the core passageway structures 60 and contacting a wax die 68. Each film hole protrusion 64 is formed by a body 70 having an end face 72 that may be enlarged with respect to the body 70. The body 70 and end face 72 may be shaped to form the film cooling hole 34 with the shaped outlet 40. An exemplary shaped outlet 40 may include a 10-10-10 configuration as is known to those in the art. FIG. 6 shows a close-up of a film hole protrusion 64 extending from one of the core passageway structures 60 near the base 14 of the airfoil, and a film hole protrusion 64 extending from approximately half way in between the base 14 and the tip 16. However, any location may be selected if a film cooling hole 34 is to be formed there.

Figure 8:
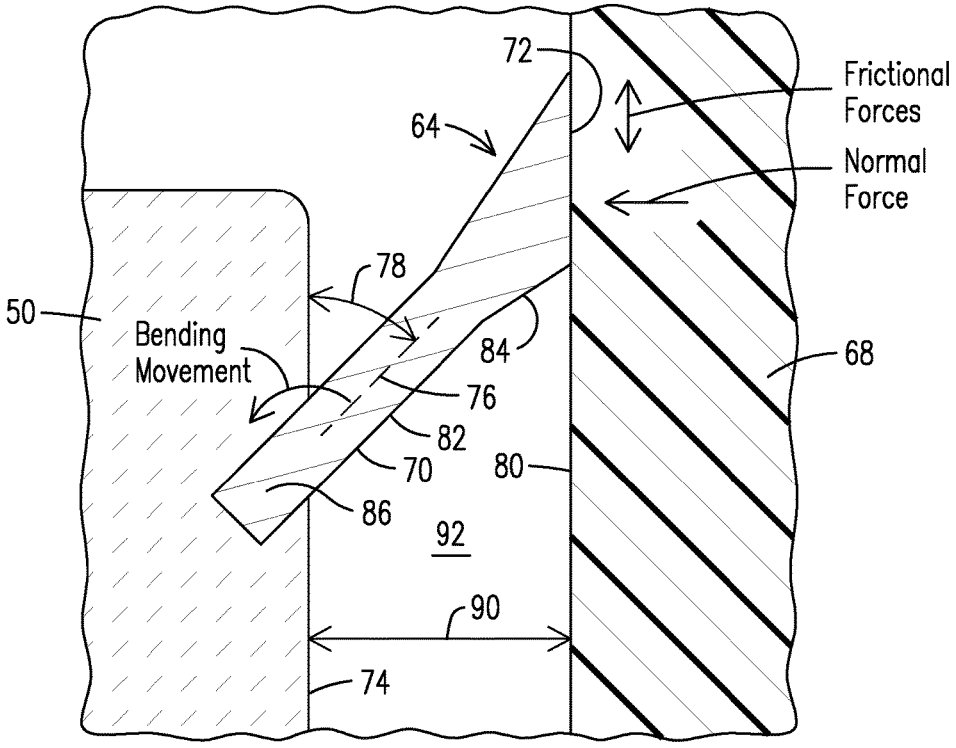
FIGS. 8-14 show cross sections depicting the casting process.

As can be seen in FIG. 8, the film hole protrusion 64 may extend from a surface 74 of the core 50 such that an axis 76 of elongation of the body 70 outside the core 50 forms an acute angle 78 with the core surface 74. The result is that the body 70 extending from the core surface 74 of the core 50 is cantilevered with respect to the core surface 74. Stated another way, the end face 72 is laterally offset along the core surface 74 with respect to where the body 70 meets the core 50.

As can be seen in FIG. 8, the end face 72 rests on and flush with (i.e. conforms to) an inner surface 80 of the wax die 68. Collectively, then, the end faces 72 define a profile that conforms to a profile defined by the inner surface 80 of the wax die 68 to effect a conforming fit between the two. By resting flush with the inner surface, no (or little) wax can get between the end face 72 and the inner surface 80. This results in a clean cooling hole outlet 40, devoid of a need to eliminate flashing from the casting process through subsequent machining.

During handling and casting operations the wax die imparts frictional and normal forces to the end face 72. Due to the cantilevered nature of the arrangement, this creates a bending moment around where the body 70 and the core 50 meet. This cantilevered arrangement renders the body 70 less able to resist forces imparted to it by an inner surface 80 of the wax die. For this reason, care must be taken to prevent damage to the film hole protrusion 64. This tradeoff is, however, considered acceptable in order to create film cooling holes 34 that are oriented to direct cooling fluid so they travel with the hot gases, or alternately, counter current with the hot gases.

In order to resist this bending moment, while still maintaining a positional relationship between the core 50 and the wax die 68, (and subsequently between the core 50 and the ceramic shell), the body 70 and the core 50 must not only be strong enough resist breaking, but must also be configured to permit a desired amount of flex, and yet mitigate any unwanted flex. In an exemplary embodiment where some flex is permitted, the positional relationship maintained by the film hole projections 64 is essentially a single, fixed positional relationship with a permissible tolerance. In an exemplary embodiment, it may be preferable to reduce and/or eliminate any flex. In an exemplary embodiment where no flex is permitted, the positional relationship maintained by the film hole projections 64 is essentially a single, fixed positional relationship without a permissible tolerance.

It can also be seen that the body 70 may include a first geometry 82 (defining the axis 76 of elongation) and a second geometry 84 of a larger and/or increasing cross sectional area. The second geometry 84 may define a diffuser portion of the subsequently formed film cooling hole 34. Thus, the film hole protrusion 64, which is defined by the first geometry 82 and the second geometry 84 (i.e. the portions of the body 70 exterior to the core surface 74), may actually increase in cross sectional area the further it gets from the core surface 74. In addition, FIG. 8 shows an alternate exemplary embodiment where the body 70 includes a third geometry 86 that extends into the core 10. This third geometry 86 may be present when the body 70 is a discrete component and is inserted into the core 10, such as when the core 50 is a green body. In such an exemplary embodiment the body 70 may be quartz, or a sintered or unsintered (green body) powder metallurgy structure. The core 50 may be sintered with the body 70 installed in the desired position to form a sintered core 10 with film hole protrusions 64 extending there from.

Alternately, the body 70 with the third geometry 86 may be joined to a completed core by, for example, inserting the third geometry 86 into recesses and bonding the body 70 to the core 50. This bonding may be accomplished by means known to those in the art, such as by using adhesives, or soldering, brazing, or welding etc. For example, a quartz body 70 may be inserted to a recess in the pressure side 62 and/or the suction side 66. If discrete bodies 70 are assembled into the core, the discrete bodies 70 may optionally be configured to form a cooling hole 34 that is different than other cooling holes machined into the casting. For example, the discrete bodies 70 may be larger to ease handling/assembly. The relatively larger film cooling hole resulting from the enlarged discrete bodies 70 may simply be larger than the other machined cooling holes, or alternately, they may serve an additional function, such as being sized to permit dust to be ejected from the internal cooling passage of the component.

While FIG. 8 shows a cross section of the film hole protrusion 64 extending from the core surface 74 on the pressure side 62 of the core 50, another or plural other film hole protrusions 64 may extend from the suction side 66 of the core 50. In such an arrangement the core 50 would then be held in a fixed positional relationship with the wax die 68. This would define a gap 90 between the core 50 and the wax die 68, and the gap 90 ultimately defines the wall thickness of the airfoil 12. The film hole protrusions 64 are of sufficient strength that they can withstand forces generated by the core 50 when the core 50 attempts to change its shape due to thermal stress. Thus, the shape of the core 50 is maintained and held in its proper position relative to the wax die 68. This means that the respective dimensions of the gap 90 are maintained all around the core 50, and this maintains dimensional control of a wax pattern cavity 92. Since the gap 90 defines the wall thickness of the airfoil 12, better dimensional control of the wall thickness is maintained using this configuration.

Figure 9:
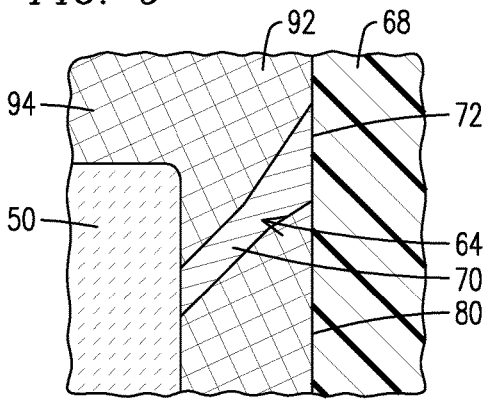
Figure 10:
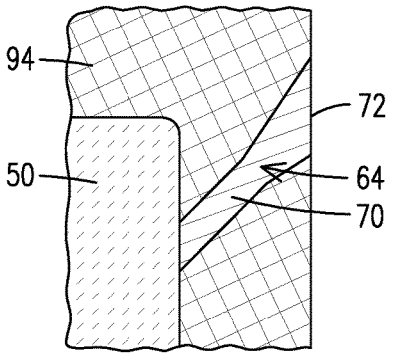
Figure 11:
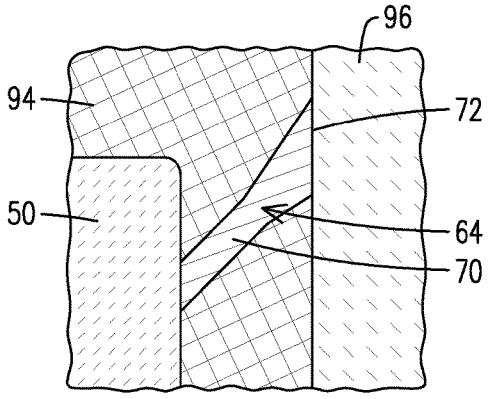

FIGS. 9-14 continue to depict the investment casting process using the structure disclosed herein. In FIG. 9, wax has been introduced into the wax pattern cavity 92 and a wax pattern 94 has been formed between the core 50 and the wax die 68. The film hole protrusion 64 holds the single, positional relationship between the core 50 and the wax die 68 during the casting of the wax pattern 94. In FIG. 10 the wax die 68 has been removed, leaving the core 50 and the surrounding wax pattern 94. Any wax that may have found its way on the end face 72 may be removed in this step, to ensure good contact between the end face 72 and the ceramic shell. In FIG. 11 the core 50 and wax pattern 94 have been dipped in a ceramic slurry to form the ceramic shell 96. The end face 72 is exposed to the ceramic slurry and thus interfaces with the ceramic shell 96, thereby forming a structure that bridges the core 50 and the ceramic shell 96. In an exemplary embodiment the ceramic shell 96 bonds to the end face 72, thereby forming a monolithic core 50 and ceramic shell 96 arrangement. In this configuration where the two are bonded to each other, not only is the gap 90 maintained, but lateral movement of the end face 72 along the inner surface 80 of the ceramic shell 96 is also prevented. This prevents the core 50 from moving relative to the inner surface 80, such as up or down in FIG. 11, and thereby maintains an even tighter positional relationship there between.

Figure 12:
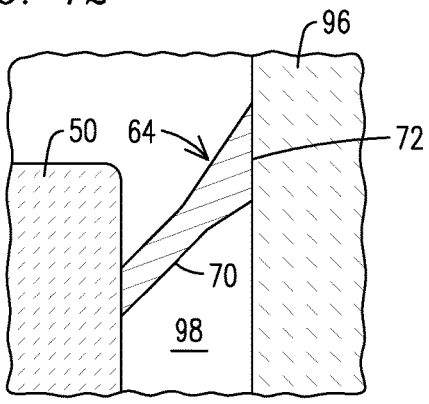
Figure 13:
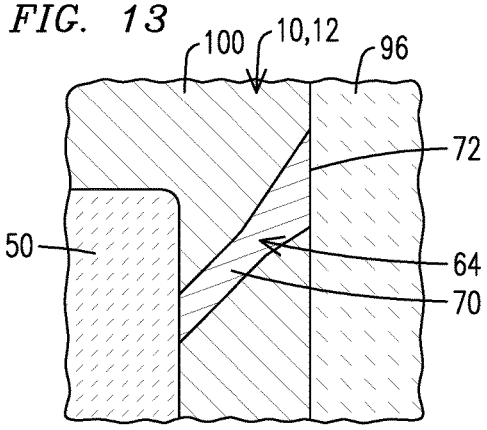

In FIG. 12 the wax pattern 94 has been removed from between the core 50 and the ceramic shell 96. This can be done thermally, or via any means known to those in the art. This leaves the core 50, the ceramic shell 96, and a mold cavity 98 defined there between, where the mold cavity 98 is bridged by the film hole protrusions 64. By bridging this mold cavity 98, the film hole protrusions 64 continue to hold the core 50 in the single, positional relationship with the ceramic shell 96. In FIG. 13 molten metal has been cast into the mold cavity 98 and around the film hole protrusion 64. Once solidified, this forms the wall 100 of the airfoil 12. The film hole protrusions 64 again hold the core 50 and the ceramic shell 96 in the fixed positional relationship, despite thermal and mechanical stresses that may occur when the relatively hot molten metal is poured, (or injected forcibly), into the mold cavity 98.

Figure 14:
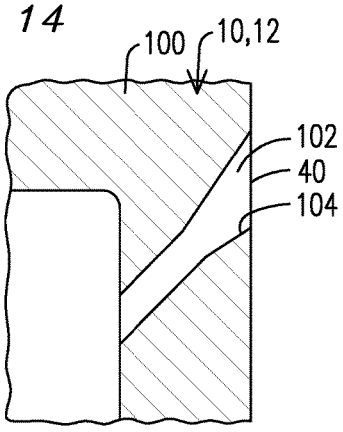

In FIG. 14 the core 50 and the ceramic shell 96 have been removed through chemical leaching or any other technique known to those in the art. What remains is the cast blade 10 having the cast airfoil 12 with the wall 100 having a cast film cooling hole 102 with a shaped outlet 40 where the film hole protrusion 64 was previously located. The cast film cooling hole 102 shown in this exemplary embodiment includes a diffuser 104 where the second geometry 84 of the body 70 was disposed. The cast film cooling hole 102 or holes formed by this casting process may constitute only a portion of the film cooling holes 34 needed to form the pattern (i.e. a row) of film cooling holes 34 that may be part of a greater film cooling hole arrangement 30. A remainder of film cooling holes 34 needed to complete the desired pattern may be machined after the casting operation. Stated another way, the pattern of film cooling holes 34 in the airfoil 12 may include one or more cast film cooling holes 102 as well as film cooling holes that are machined into the airfoil 12 subsequent to the casting operation. For this to happen, the locations selected for the film hole protrusions 64 must be such that at least two goals are achieved. First, the fixed positional relationship must be maintained. Second, the cast film cooling holes 102 resulting from the presence of the film hole protrusions 64 are to be positioned such that they naturally become part of a pre-planned pattern of film cooling holes.

One advantage of forming the pattern using a combination of cast cooling holes and subsequently machined cooling holes is that more than one pattern and associated film cooling arrangement 30 can be fabricated from a single casting configuration. For example, should it be determined that the subsequently machined cooling holes should have a decreased or increased diameter, that change can be accommodated using the same core 50. Increased cooling may be desired when, for example, a given gas turbine engine is upgraded to operate at a higher temperature to increase efficiency. In this instance, the blade remains the same, but more cooling is necessary. The greater cooling needed with the finished upgraded blades can be accomplished by machining different, or more, film cooling holes in the same casting that can be used to make finished blades for the engine before it was upgraded. Further, should it be determined that fewer machined film cooling holes are necessary, the unwanted holes would simply not be drilled. Consequently, the arrangement and method disclosed herein provide increased flexibility.

From the foregoing it can be seen that the inventors have devised a unique and innovative positioning arrangement that improves dimensional control of the mold cavity while not creating a structure that leaks air from the cooling passage of the resulting airfoil. The result is improved dimensional control of the wall thickness of the airfoil, and less subsequent machining needed to form film cooling holes. Consequently, this represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A method of forming an airfoil, comprising:

forming film hole protrusions on a ceramic core at locations that correspond to locations of select film cooling holes within a pattern of film cooling holes on an airfoil formed by the ceramic core;

using the film hole protrusions to hold the ceramic core in a fixed positional relationship with a wax die while forming a wax pattern around the ceramic core;

removing the wax die;

forming a ceramic shell that surrounds the wax pattern and contacts surfaces of the film hole protrusions;

removing the wax pattern;

using the film hole protrusions to hold the ceramic core in a fixed positional relationship with the ceramic shell while casting the airfoil around the ceramic core; and machining film cooling holes in the airfoil after the casting step to form the pattern of film cooling holes comprising the film cooling holes formed by the machining step and separate cast film cooling holes formed by the film hole protrusions during the casting step.

2. The method of claim 1, wherein each of the film hole protrusions comprises an enlarged end face, each end face configured to rest on and flush with an inner surface of the wax die.

3. The method of claim 1, wherein each of the film hole protrusions is fixed to the ceramic core in a manner effective to resist a bending moment of the film hole protrusion with respect to the ceramic core resulting from a force imparted to a laterally offset end face of the respective film hole protrusion.

4. The method of claim 1, further comprising integrally casting the film hole protrusions as part of the ceramic core.

5. The method of claim 1, further comprising forming the film hole protrusions on the ceramic core by assembling discrete film hole protrusion bodies into a partly sintered ceramic core.

6. The method of claim 5, wherein the film hole protrusion bodies comprise quartz.

7. The method of claim 5, wherein the film hole protrusion bodies are disposed on at least one of a pressure side and a suction side of the ceramic core.

8. The method of claim 1, further comprising:

removing the ceramic core, the film hole protrusions, and the ceramic shell; and forming a remainder of the film cooling holes in the pattern of film cooling holes.

* * * * *